US005650601A

United States Patent [19]

Krueger et al.

[11] Patent Number: 5,650,601

[45] Date of Patent: Jul. 22, 1997

[54] SEALED SWITCH ASSEMBLY FOR USE WITH A ROTATABLE VALVE SHAFT

[75] Inventors: Donald M. Krueger, Westchester, Ill.; Paul D. Frazier, West Plains, Mo.

[73] Assignee: Eaton Corporation, Cleveland, Ohio

[21] Appl. No.: 479,094

[22] Filed: Jun. 6, 1995

[51] Int. Cl.[6] ..... H01H 9/06

[52] U.S. Cl. ..... 200/61.86; 200/11 R

[58] Field of Search ..... 200/11 R–11 TW, 200/61.85, 61.86, 293, 295, 302.1

[56] References Cited

U.S. PATENT DOCUMENTS

| | | | |
|---|---|---|---|
| 3,502,835 | 3/1970 | Batcheller | 200/154 |
| 3,971,904 | 7/1976 | Ward | 200/6 BB |
| 4,016,387 | 4/1977 | Aberer | 200/303 |
| 4,019,855 | 4/1977 | Camillo | 431/256 |
| 4,249,047 | 2/1981 | Huff et al. | 200/61.86 |
| 4,342,886 | 8/1982 | Demi | 200/61.86 |
| 4,371,764 | 2/1983 | Runion | 200/61.86 |
| 4,612,423 | 9/1986 | Munroe | 200/16 R |
| 5,008,498 | 4/1991 | Yamazaki | 200/11 R |

*Primary Examiner*—Michael L. Gellner
*Assistant Examiner*—Michael A. Friedhofer
*Attorney, Agent, or Firm*—Roger A. Johnston

[57] ABSTRACT

A gas burner valve switch having an annular rotor engaging the valve shaft for rotation with the shaft. An annular resilient seal in a groove on the rotor flange seals against the underside of the casing cover to prevent entry of foreign matter. The rotor is journalled for rotation in the housing which has spaced terminals which connect, via insulation displacement, with a pair of continuous spaced electrical leads laid in channels and extending through the housing. In one embodiment the rotor has a cam which actuates a moveable blade arm attached to one of the pair of terminals to effect closing against the other terminals. In another embodiment an annular wiper ring acts as a shorting bar between the terminal for switching upon user rotation of the rotor.

10 Claims, 3 Drawing Sheets

152
158
154
156
158
150
144
124
148
128
130
126
134
136
100
146
138
140
142
138
142
142
142
138
106
110
118
114
111
132
122
104
108
112
120
116
102

SEALED SWITCH ASSEMBLY FOR USE WITH A ROTATABLE VALVE SHAFT

BACKGROUND OF THE INVENTION

The present invention relates to switches of the type adapted to be received over a rotatable shaft and particularly a rotatable valve shaft such that upon user rotation of the valve shaft to a desired position, the switch is actuated or deactuated for making or breaking a circuit. Such switches are employed in valves utilized for controlling flow to range top gaseous fuel burners where the valve shaft is arranged to extend through the switch and has a knob provided on the end thereof to facilitate manual actuation by the user. In gas burner valve applications, it is commonplace to have the switch close a circuit for energizing an electrical spark ignitor when the burner valve shaft has been rotated to a desired predetermined position for opening of the gas valve to permit fuel flow to the burner.

In gas burner valve switch applications, problems have been experienced with spillage of foodstuffs and liquids on the range tops and seepage of same into the interior of the switch resulting in contamination of the contacts and deterioration of the switch performance. This has been particularly troublesome where the gas burner ignitor switch is received over the shaft of the individual burner valve and secured to the valve body by fasteners such that one side of the switch is registered against the valve body and the remaining portions of the switch are exposed to the burner well in the range top. Thus, it has been desired to provide a way or means of protecting the switch in gas burner valve applications from contamination particularly from liquid foodstuffs which could result in deterioration of the electrical switch contacts within the switch housing. It has also been desired to provide a reliable gas burner valve switch that is resistant to contamination and which is economical to manufacture in high volume productions for consumer appliance applications. It has also been desired to provide a rotary switch, adapted for receipt on a shaft, which is resistant to contamination and which may be attached to continuous electrical leads.

SUMMARY OF THE INVENTION

It is an object of the present invention to provide a sealed switch assembly for use with a rotatable shaft and particularly the shaft of a rotatable valve.

It is a further object of the present invention to provide a sealed switch assembly for use with a rotatable shaft and which is simple in design and has a relatively low manufacturing cost and provides reliable switching upon rotation of the shaft to a predetermined position.

It is a further object of the present invention to provide a switch adapted for receipt on a rotatable valve shaft which is resistant to contamination and which may be connected to continuous electrical leads.

The present invention employs an annular rotor adapted to be received over a shaft in driving engagement such as a valve shaft and which is rotatable therewith, the rotor being journalled in a housing containing a switch operative for making and breaking a circuit responsive to rotation of the rotor to a certain position. The rotor has an annular flange extending radially outwardly therefrom which has provided between the flange and the housing an annular seal ring for sealing the rotor against the housing. The housing has a pair of spaced terminal means provided therein which are adapted to receive therein in electrical contact by insulation displacement a pair of continuous electrical leads passing through the switch housing. Electrical switch means are provided within the housing for, upon rotation of the rotor, effecting the making and breaking of an electrical circuit between the spaced terminal means. In one embodiment the switch means comprises a moveable blade member actuated by a cam on the rotor; and, in another embodiment the switch means comprises an arcuate shorting bar rotatable with a rotor for effecting the making and breaking of electrical contact between the spaced terminal means.

DETAILED DESCRIPTION

Figure 1:
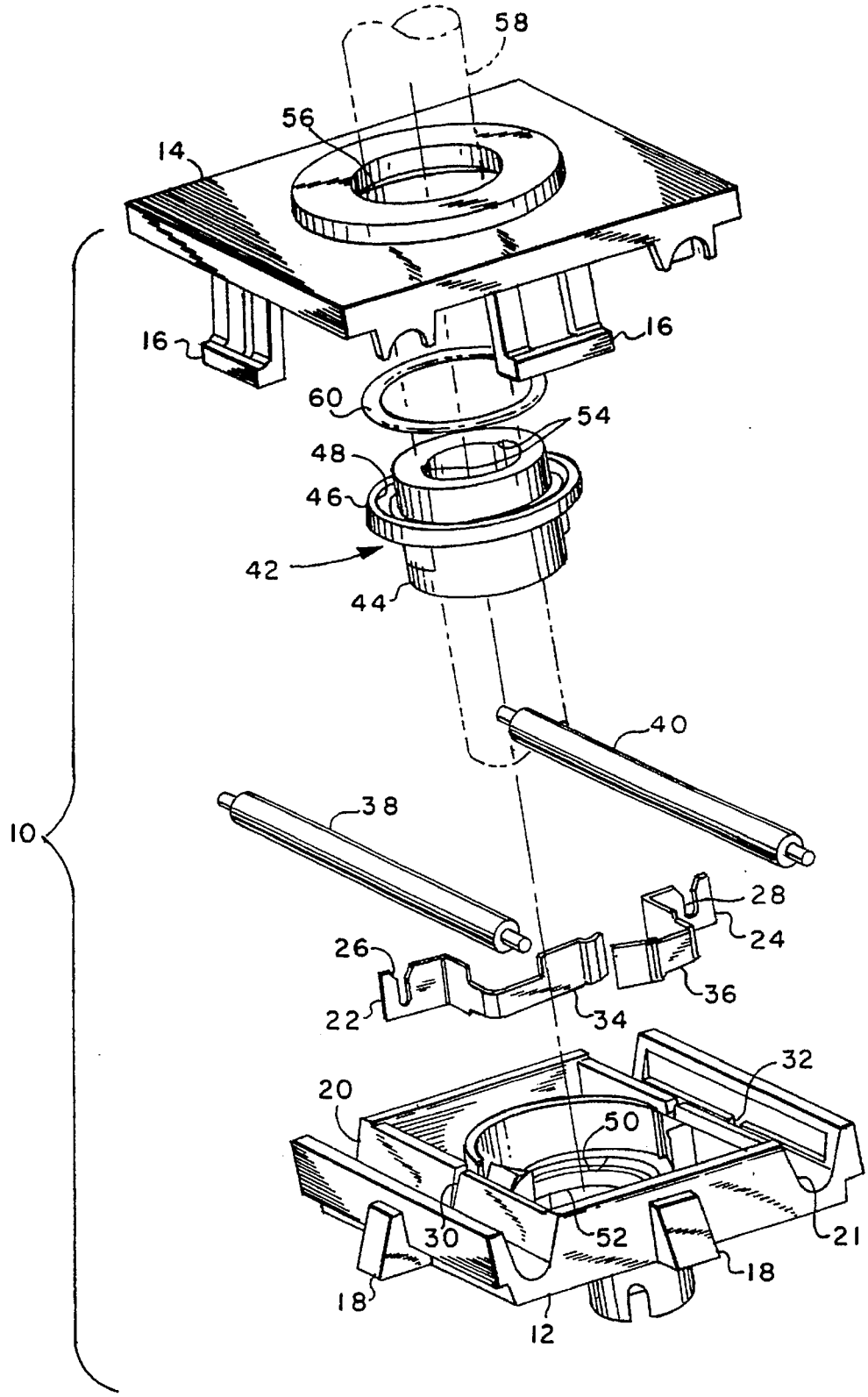
FIG. 1 is an exploded view of one embodiment of the invention employing a rotary cam actuated switch.
Figure 2:
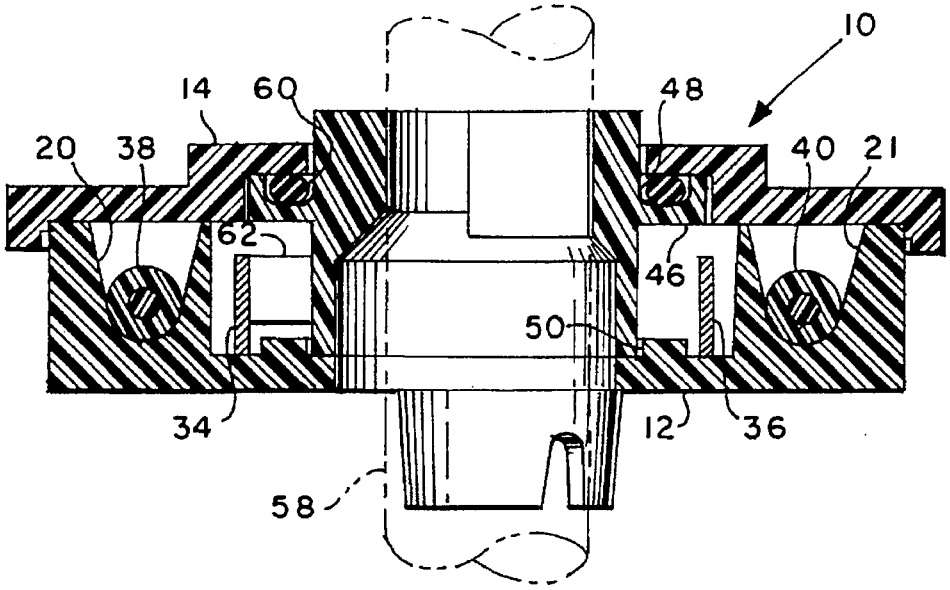
FIG. 2 is a cross-section of the switch of FIG. 1 in the assembled condition.

Referring to FIGS. 1 and 2, the switch assembly of the present invention is illustrated generally at 10 and includes a base preferably in the form of an open shell 12 and a cover 14 releasably attached to the base by any convenient expedient such as snap tabs 16 which are engaged over lugs or barbs 18 provided on the base. The base has a pair of spaced generally parallel channels 20, 21 for electrical leads as will hereinafter be described.

A pair of electrical terminals 22, 24 are formed preferably of strip material with a wire receiving slot formed therein denoted by reference numerals 26, 28 respectively. The terminal 22 is received in a recess or slot 30 formed in the side of channel 20 with terminal 24 received in a corresponding recess or slot 32 formed in the side channel 21. Terminal 22 has a moveable contact blade arm portion 34 formed integrally therewith; and, terminal 24 has a contact arm 36 formed integrally therewith and extending therefrom. Contact arm 36 in the illustrated embodiment functions as a stationary contact; whereas, contact blade arm 34 functions as a moveable contact blade as will hereinafter be described. With the terminals 22, 24 received in the slots in the base 12, individual electrical leads 38, 40 are pressed in the slots 28, of each terminal with the edges of the slots displacing or piercing the insulation on the leads and making electrical contact with the conductor therein enabling the leads to be received in and passed through the switch housing 12 as a continuous member without the need to break the leads for connection or form a splice.

An annular rotor indicated generally at 42 has a hub portion 44 and an annular radially outwardly extending flange 46 which has a groove 48 formed in one axial face of the flange. The hub 44 is journalled for rotation in annular groove 50 provided in the base 12 which is concentric with an aperture or cut-out 52 formed therethrough, the annular groove 54 allowing free access to the lower end of the hub 44. Hub 44 has the inner periphery thereof provided with a pair of oppositely disposed flat portions 54 which are adapted to engage a corresponding flat surface (not shown) on the shaft of a rotary valve. The valve shaft is indicated in dashed outline in FIG. 1 and denoted by reference numeral 58. Similarly, a cut-out or aperture 56 is provided in the cover 14 for permitting the valve shaft 58 to extend through the rotor 42 and outwardly through the cover 14.

An annular resilient seal, preferably in the form of a O-ring 60, is received in the groove 48 in the rotor flange and seals the flange against the undersurface of the cover 14 to prevent entry of foreign matter into the interior of the housing.

Rotor hub 44 includes at least one cam lobe 62 provided on the rotor for, upon rotation, effecting movement of the contact blade 34 to close against the contact 36.

Figure 4:
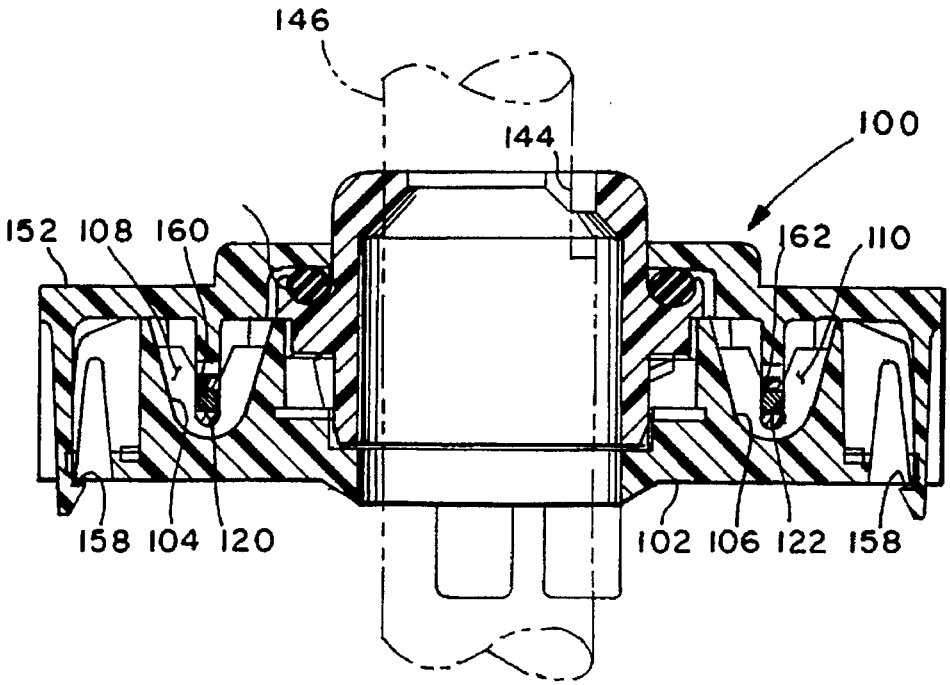
Figure 3:
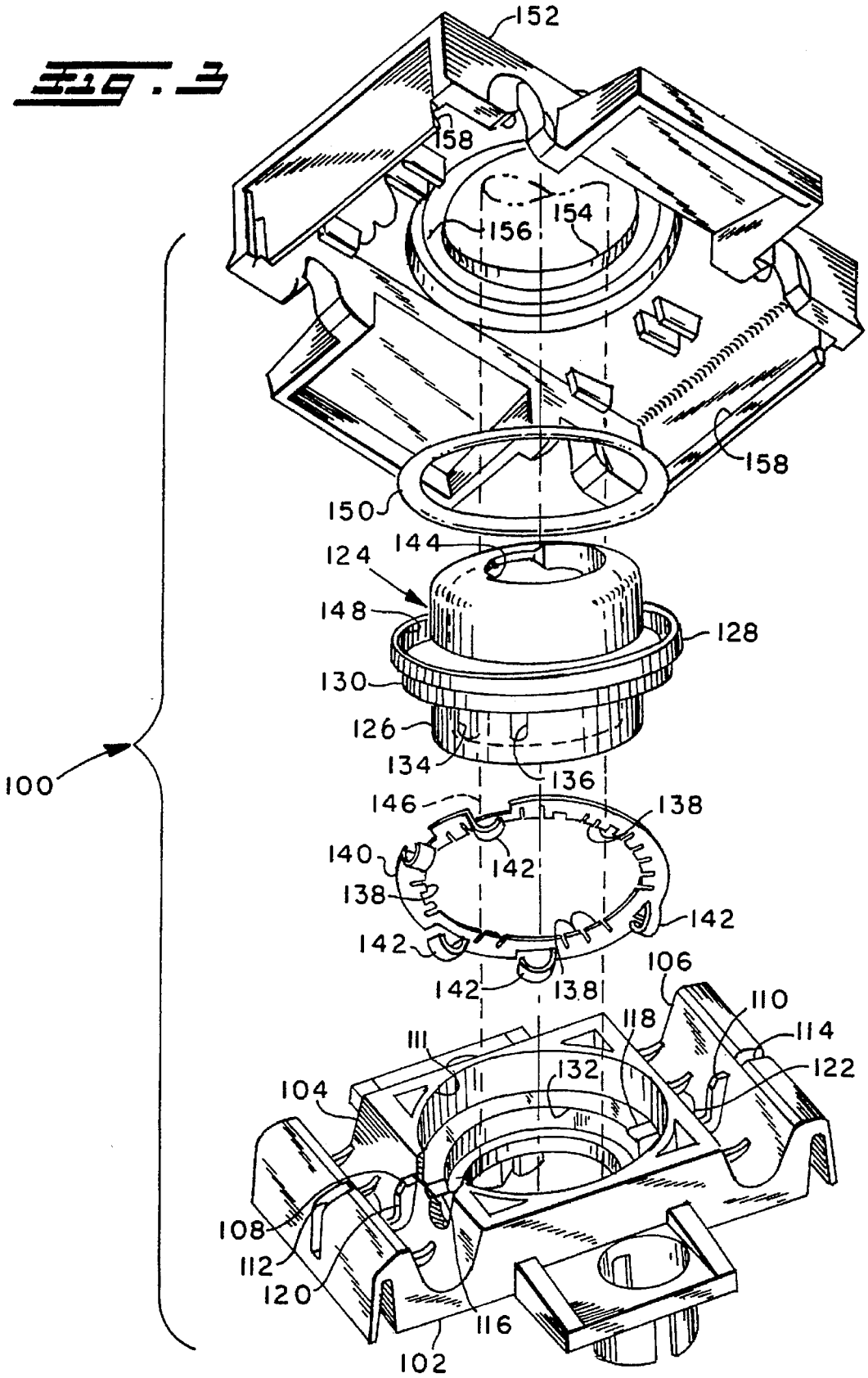
FIG. 3 is a view similar to FIG. 1 of an alternate embodiment of the invention employing a rotatable shorting bar; and, FIG. 4 is a cross-section of the embodiment of FIG. 3 in the assembled condition.

Referring to FIGS. 3 and 4, another embodiment of the invention indicated generally at 100 comprises a lower shell or base 102 having a pair of spaced parallel channels 104, 106 formed therethrough adapted to receive electrical leads in a manner similar to the channels 20, 21 of the embodiment of FIG. 1.

A pair of contact terminals 108, 110 are disposed on opposite sides of a central cavity 111 formed in the base, with the terminals each received in a cut-out or slot denoted respectively 112, 114 extending transversely to the grooves 104, 106. Each of the terminals 108, 110 has a portion thereof extending through the wall of the channels and into the cavity to form stationary electrical contacts denoted by reference numerals 116, 118 respectively.

Each of the terminals 110, 112 has a slot denoted respectively 120, 122 formed therein which is adapted to have a continuous electrical lead received therein such that the slot displaces or cuts the lead insulation and makes electrical contact with the conductor in the lead. It will be understood that the electrical leads have been omitted in FIG. 3, but are shown in FIG. 4.

An annular rotor indicated generally at 124 has a hub 126 with an annular flange extending radially outwardly therefrom as denoted by reference numeral 128 which has an annular shoulder 130 provided thereon which is registered in a journalling counter-bore 132 provided in the base. The counter-bore 132 and shoulder 130 function as a labyrinth to trap foreign matter from entering the interior of the switch housing over the lower end of the hub. The rotor hub 126 has formed thereon a plurality of recesses 134, 136 spaced thereabout. Recesses 134, 136 are engaged by correspondingly spaced tabs 138 disposed about the inner periphery of a conductor ring 140 which is press fitted over the hub 126 to register against the undersurface or lower axial face of flange 128. The tabs 138 snap into the grooves 134, 136 to provide transmission of torque between the hub 126 and the ring 140. The wiper ring 140 has a plurality of wiper contacts 142 extending from one axial phase thereof in a generally downward direction in FIG. 3.

The rotor 124 has a pair of spaced flat surfaces 144 formed on the inner periphery thereof which are adapted for driving engagement with a corresponding flat surface (not shown) formed on a valve shaft 146 indicated in dashed outline in FIG. 4. The enlarged diameter flange 128 of the rotor has an annular groove 148 formed in the axial surface thereof opposite the conductor ring 140; and, groove 148 has received therein an annular resilient seal ring, preferably an O-ring, denoted by reference numeral 150.

A cover member forming part of the switch assembly housing is indicated at 152 and has formed therein an aperture 154 which is received over the hub of the rotor and has a counterbore surface 156 formed on the inside thereof which surface contacts and seals against the O-ring 150. Cover 152 has releasable attachment means thereon comprising in the illustrated embodiment 100 barbed tabs on the sides thereof indicated by reference numerals 158, which barbs engage the sides of the base 102 for releasable snap locking engagement of the cover 152 over the base 102.

It will be understood that rotation of the valve shaft 146 by the user effects rotation of rotor 124 and conductor ring 140 to cause the wiper contacts 142 to short across the stationary contacts 116, 118 for completing a circuit between the electrical leads denoted by reference numerals 160, 162 in FIG. 4.

The present invention thus provides a unique and novel switch assembly adapted for being received over a rotatable shaft, particularly a valve shaft, wherein the switch has an annular rotor which is engaged by surfaces on the shaft and rotated thereby. Rotation of the switch rotor effects making and breaking of contacts interiorly of the switch housing which has a pair of continuous electric leads pressed therein for insulation displacing electrical contact with the conductor in the leads and secured by a cover snapped over the housing. An annular seal ring on the rotor seals against the undersurface of the cover and protects the contacts within the switch housing from contamination by foreign matter. The switch is thus ideally suitable for use with a gas burner valve shaft for controlling the spark ignitor circuit upon user rotation of the valve shaft to a position permitting fuel to flow to the burner.

Although the present invention has hereinabove been described with respect to the illustrated embodiments, it will be understood by those having ordinary skill in the art that the invention is capable of modification and variation and is limited only by the following claims.

We claim:

1. A switch assembly for use with a valve having a rotatable shaft comprising:

(a) housing means comprising a base and a cover releasably attached to said base, said base and cover each having a cut-out therein;

(b) a pair of spaced generally parallel insulated electrical conductors, each extending continuously through said housing means;

(c) first and second spaced electrical terminal means each disposed in one of said base and cover and each operative to make electrical contact through said insulation with one of said electrical conductors received through said housing means, said first and second terminal means including a first electrical contact means;

(d) an annular rotor in driving engagement with said valve shaft, said rotor disposed in said housing with an inner periphery of said rotor aligned with said cut-outs;

(e) a switching means operable upon rotation of said rotor to close said first and second contact means to complete a circuit between said first and second terminal means; and, (f) annular seal means operative to provide a rotatable seal between said rotor and at least one of said base and cover.

2. The switch assembly defined in claim 1, wherein said switching means is formed by said rotor including a cam and one of said first and second contact means including a moveable blade operably moved by said cam to close against the other of said first and second contact means.

3. The switch assembly defined in claim 1, wherein said switching means includes a shorting bar mounted for rotation on said rotor and operable to complete a circuit between said first and second contact means.

4. The switch assembly defined in claim 1, wherein said switching means includes an annular conductive member mounted for rotation with said rotor; and, said first and second contact means includes a pair of stationary contacts and said annular member has portions thereof operable upon rotation of said rotor, to complete a circuit between said stationary contacts.

5. The switch assembly defined in claim 1, wherein said annular seal means comprises a resilient O-ring.

6. The switch assembly defined in claim 1, wherein one of said first and second contact means includes a moveable contact blade attached to one of said first and second terminal means, and said annular rotor includes a cam operable upon rotation of said rotor to effect movement of said contact blade.

7. The switch assembly defined in claim 1, wherein said housing means includes an open shell member having said terminal means mounted therein and a cover member releasably attached to and closing said shell.

8. The switch assembly defined in claim 1, wherein said rotor has an annular radially outwardly extending flange having an annular groove formed therein with said annular seal means disposed in said groove.

9. The switch assembly defined in claim 1, wherein said pair of electrical conductors passes through said base.

10. The switch assembly defined in claim 1, wherein one of said first and second contact means includes a member moveable by said rotor.

* * * * *